US007987992B2

(12) United States Patent
Laurin et al.

(10) Patent No.: US 7,987,992 B2
(45) Date of Patent: Aug. 2, 2011

(54) COKE SEPARATION PROCESS IN PASTE PLANT

(75) Inventors: Pierre Laurin, Jonquiere (CA); Nathalie Bouchard, Jonquiere (CA); Weixia Chen, Coquitlam (CA); Cyril Gaudreault, Jonquiere (CA); Yvon Ménard, Chicoutimi (CA)

(73) Assignee: Rio Tinto Alcan International Limited, Montreal CA (CA)

( * ) Notice: Subject to any disclaimer, the term of this patent is extended or adjusted under 35 U.S.C. 154(b) by 197 days.

(21) Appl. No.: 11/970,988

(22) Filed: Jan. 8, 2008

(65) Prior Publication Data

US 2008/0173573 A1 Jul. 24, 2008

Related U.S. Application Data

(60) Provisional application No. 60/883,939, filed on Jan. 8, 2007.

(51) Int. Cl.

| | |
|---|---|
| ***B03B 4/00*** | (2006.01) |
| ***B03B 11/00*** | (2006.01) |
| ***B03B 5/20*** | (2006.01) |
| ***B07B 1/28*** | (2006.01) |
| ***B07B 7/10*** | (2006.01) |

(52) U.S. Cl. ..... 209/466; 209/315; 209/468; 209/469; 209/472; 209/488

(58) Field of Classification Search ..... 209/315, 209/466, 468, 469, 472, 488, 489, 497, 499, 209/502

See application file for complete search history.

(56) References Cited

U.S. PATENT DOCUMENTS

| | | | | |
|---|---|---|---|---|
| 1,900,190 | A * | 3/1933 | Menzies | 209/160 |
| 2,028,904 | A * | 1/1936 | Haworth | 209/467 |
| 2,058,713 | A * | 10/1936 | Needham | 209/441 |
| 2,620,067 | A * | 12/1952 | Halza | 209/156 |
| 3,485,361 | A | 12/1969 | Adams | |
| 3,773,176 | A * | 11/1973 | Loughner | 209/459 |
| 4,039,425 | A * | 8/1977 | Neavel | 208/424 |
| 4,793,918 | A | 12/1988 | Thomas | |
| 4,919,793 | A * | 4/1990 | Mallari | 208/131 |

(Continued)

FOREIGN PATENT DOCUMENTS

| | | |
|---|---|---|
| GB | 427 499 | 4/1935 |
| WO | 82/02503 | 8/1982 |

OTHER PUBLICATIONS

S. Wilkening, "Review of Recent Advances in Carbon Technology," Light Metals 1997, Canadian Institute of Mining, Metallurgy and Petroleum, 1997, pp. 269-280.

*Primary Examiner* — Stefanos Karmis
*Assistant Examiner* — Michael E Butler
(74) *Attorney, Agent, or Firm* — Banner & Witcoff, Ltd.

(57) ABSTRACT

The invention describes a process and apparatus producing a dense coke fraction from a first particulate coke fraction having a first average density and a first average particle size distribution, stratifying the coke fraction in a density separator into at least two fractions, the at least two fractions comprising a light coke fraction and the dense coke fraction. The dense fraction having an average density greater than the first average density and a particle size distribution substantially equivalent to the first average particle size distribution. The apparatus includes an inclined oscillating table comprising a gas-pervious deck, and a gas mover.

21 Claims, 7 Drawing Sheets

U.S. PATENT DOCUMENTS 5,034,116 A * 7/1991 Newman ..... 208/131
5,197,398 A * 3/1993 Levy et al. ..... 110/347
6,332,975 B1 * 12/2001 Abdel-Halim et al. ..... 208/131
6,422,494 B1 * 7/2002 Reeves et al. ..... 241/81
6,838,024 B1 * 1/2005 Dreyer et al. ..... 264/29.1
2003/0183558 A1 * 10/2003 Sandlin et al. ..... 209/31

* cited by examiner

COKE SEPARATION PROCESS IN PASTE PLANT

CROSS REFERENCE TO RELATED APPLICATION

This Non-Provisional Application claims benefit to U.S. Provisional Application Ser. No. 60/883,939 filed Jan. 8, 2007.

BACKGROUND OF THE INVENTION

1. Technical Field

The invention relates to a process and apparatus for separation of petroleum coke on the basis of density, and particularly to producing a dense coke fraction used in the production of carbon anodes for aluminum production.

2. Description of the Prior Art

Carbon anodes are produced in a paste plant for the electrolytic reduction of aluminium. Roughly one tonne of carbon is consumed for every two tonnes of aluminium produced. A typical source of carbon for the paste plant is calcined petroleum coke. Coke density has an important impact on the anode properties. The coke raw material arrives in the plant as a material having a wide range of particle sizes and densities. In the anode plant, the coke is separated into various size fractions. A specific amount of each size fraction goes into the production of an anode in order to produce a predefined granulometry in the finished anode necessary to meet performance specifications.

WO 82/02503 by Forsberg et al., discloses an air stream separator for separating a heavier fraction such as stones, from a mixture of lighter particles with differing properties. The separator comprises a vibrating conveyor and a series of air nozzles directed in generally the conveying direction at the discharge end of the conveyor. Both lighter and heavier fractions are collected on a rocking chute having a horizontal portion and an inclined portion. The lighter fraction discharging from the conveyor is entrained in the air stream from the air nozzle onto the horizontal portion of the rocking chute, where the lighter fraction and is collected at a side outlet opening. WO 82/02503 teaches that the heavier stone fraction landing on the inclined portion of the rocking chute is not able to move upward and the heavier stone fraction is discharged at the lower inclined end of the separator.

U.S. Pat. No. 3,485,361 by Adams discloses a device for separating workpieces from machining chips and turnings. The device comprises a perforated grid on which a mixture of workpieces/chips/turnings are placed, the mixture is fed onto a shaker chute, at whose discharge the mixture is exposed to a high velocity air stream directed upwards through the grid at the mixture of workpieces/chips/turnings. The lighter chips and turnings are entrained in the air stream while the workpieces are appropriately discharged without being entrained.

U.S. Pat. No. 4,793,918 by Thomas discloses a gravity separator for particulate matter deposited on a perforated separator deck. The rate of separation is controlled by varying the end raise and the side tilt of the separator and includes and air supply directed to separate areas of the deck. The deck includes at least two perforated covers separated by transverse ribs, these features improve the solids separation. The U.S. Pat. No. 4,793,918 separator discloses that the heavier portion is discharged at the lower end of the tilted separator deck.

GB427,499 by Barker discloses an apparatus for separating dirt from coal where material enters an incoming fed trough and descends along a series of tilted reciprocating decks with an air-pervious bottom. The dirt/coal mixture is subjected to an upward current of air which helps to stratify the materials. The dirt/coal stratify while tumbling down the tilt of the decks. The denser and finer dirt is discharged at a first trough outlet with the lighter coal continuing down the tilted deck in a layer above the dirt being discharged. This lighter coal is subjected to second air-pervious deck similar to the first deck where a coal/dirt stream is discharged in a second trough outlet and returned to the incoming feed trough. The lightest and largest particle size clean coal fraction passes over a weir plate for collection.

U.S. Pat. No. 6,838,024 B1 relates to a production process to obtain carbon blocks intended for aluminium production. The process of U.S. Pat. No. 6,838,024 comprises separation of an initial carbon input into at least two size fractions, and taking most of these size fractions and crushing and mixing them together to obtain a product having a controlled proportion of ultra fine particles. This patent teaches that the presence of ultra fine particle grains increases the density of carbon blocks produced.

S. Wilkening teaches in "Potentialities in the Paste Plant", Light Metals, 1997, pages 569-576, that coke may be separated on the basis of density. Wilkening states that given the same particle size recipe a higher apparent density will have a favourable effect on the strength permeability and resistivity of the carbon produced. An air knife is suggested by Wilkening for the coke density separation.

SUMMARY OF THE INVENTION

It is an aim of the present invention to produce a densified coke product for the production of carbon anodes, having increased density.

It is a further aim of the present invention to continuously produce the densified coke in a controllable manner.

In accordance with one aspect of the present invention there is provided a process for producing a dense coke fraction for carbon anode production, the process comprising steps of: providing a first particulate coke stream having a first average density and a first average particle size distribution; feeding the first particulate coke stream to a density separator at an incoming flow rate; and using the density separator to stratify and separate the first particulate coke stream into at least two separate particulate fractions of different average density, the at least two fractions comprising a light coke fraction and the dense coke fraction, the dense coke fraction having an average density which is greater than the first average density and an average particle size distribution substantially equivalent to the first average particle size distribution.

In accordance with another aspect of the present invention there is provided a process for producing a dense coke fraction for carbon anode production, the process comprising steps of: providing an incoming particulate coke stream, combining the incoming particulate coke stream with a recycle stream to produce a combined feed coke stream, feeding the combined feed coke stream to a particle size separator, separating the combined feed coke stream into one oversize coke fraction, at least one mid-size coke fraction, and an undersize size fraction, wherein the mid-size coke fraction has a first average density and a first average particle size distribution; feeding the mid-size coke stream to a density separator at an incoming flow rate; and using the density separator to stratify and separate the mid-size coke stream in into at least two separate particulate fractions of different average density, the at least two fractions comprising a light coke fraction and the dense coke fraction, the dense coke fraction has an average density which is greater than the first average density and an average particle size distribution substantially equivalent to the first average particle size distribution.

In accordance with a further aspect of the present invention there is provided an apparatus for producing a dense coke fraction for carbon anode production, the apparatus comprising: an inclined oscillating table comprising: an upper end discharging the dense coke fraction, a lower end, and a particulate coke retaining deck extending between the upper end and the lower end, the deck being gas-pervious and adapted for receiving a first coke stream to be densified to the dense coke fraction; and a gas mover, producing a gas flow rate through the gas-pervious deck.

In accordance with yet a further aspect of the invention there is provided an apparatus for producing a dense coke fraction for carbon anode production, the apparatus comprising: a particle size separator having at least two decks producing an oversize coke fraction, at least one mid-size coke fraction and an undersize fraction, a coke transferring apparatus transferring the at least one mid-size coke fraction to a density separator, the density separator having an inclined oscillating table comprising: an upper end discharging the dense coke fraction, a lower end, and a particulate coke retaining deck extending between the upper end and the lower end, the deck being gas-pervious and adapted for receiving a first coke stream to be densified to the dense coke fraction; and a gas mover, producing a gas flow rate through the gas-pervious deck.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

In carbon anode fabrication, the starting material, petroleum coke, is understood to be a particulate carbon containing material obtained from crude oil which has been treated to remove any volatile components. It is known that petroleum coke contains particles of various densities. Lower density particles arise from a variety of reasons but primarily because low density coke includes a larger percentage of pores. Therefore as the percentage of low density coke present in the anodes increases, the density, and the mechanical and electrical properties of the anodes decrease.

The present invention provides a process and an apparatus to increase the density of particulate petroleum coke fractions used in anode production. The process of the present invention includes the advantage that during operation both the process and the apparatus tend to be self-regulating. The skilled practitioner would understand the expression "self-regulating" to mean that the process and apparatus continue to produce a consistently densified particulate coke fraction despite fluctuations in the incoming petroleum coke raw material being fed to the process and apparatus.

Figure 1:
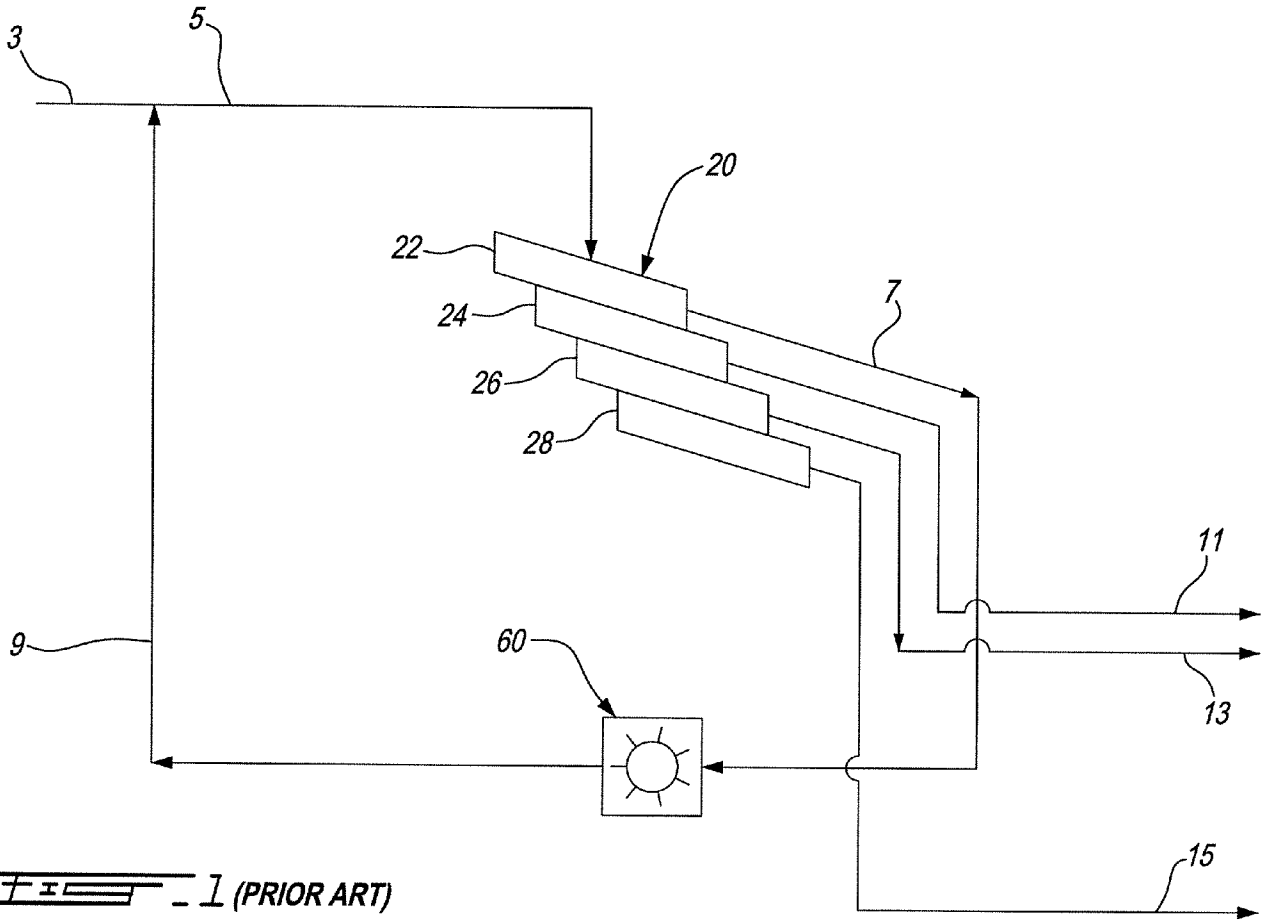
FIG. 1 (PRIOR ART)
FIG. 1 is a process flow diagram for the preparation of various coke fractions according to the prior art.

FIG. 1 represents a process of the separation of petroleum coke according to the prior art, which is based exclusively on particle size classification of the petroleum coke. The system of FIG. 1 produces coke fractions having consistent particle size distribution, and does not consider increasing the density of the petroleum coke fractions.

A stream of calcined petroleum coke 3 is fed to a size classification system and may have a wide range particle size. An anode plant of FIG. 1, typically uses an incoming petroleum coke material stream 3 and separates the material into several size specific fractions. These size fractions are combined in appropriate proportions for anode production.

An incoming petroleum coke stream 3 is combined with a recycle stream 9 to produce a combined stream of petroleum coke 5. Combined stream 5 is transported by an appropriate powder conveyer or system towards a particulate size separator. The particulate size separator is typically a multi-deck vibrating screen 20 having various screen mesh sizes, which separate or cut the combined petroleum coke stream 5 into various size fractions.

The first, uppermost deck 22 of the screen 20 removes the largest particle size fraction or "oversize" fraction. One or more "mid-size" fractions (in this case 2 are illustrated) 11, 13 are withdrawn from one or more intermediate decks 24,26. The "undersize" fraction that has passed through all the screens, is collected at the bottom 28 of the screen 20. The system of conveyors, the vibrating screen 20 (or screens) and the crusher 60 are all equipment types that are well known to the skilled practitioner.

The "oversize" stream 7 is transported by an appropriate conveyor or system of conveyors to a crusher 60. The crusher 60 reduces the size of the petroleum coke "oversize" fraction 7 to that more appropriate for anode production. As has been seen the crushed material stream 9 is recycled and combined with incoming stream 3 to produce combined stream 5. The multi-deck screen 20 further separates the incoming size fraction into two "mid-size" fraction streams 11 and 13. The "undersize" fraction stream 15 is collected at the bottom 28 of the screen 20 and is transported appropriately for further milling (not shown) to achieve even finer particle sizes needed for anode production. It will be understood that the apparatus may include various hoppers for temporary storage product and feed controllers.

Figure 2:
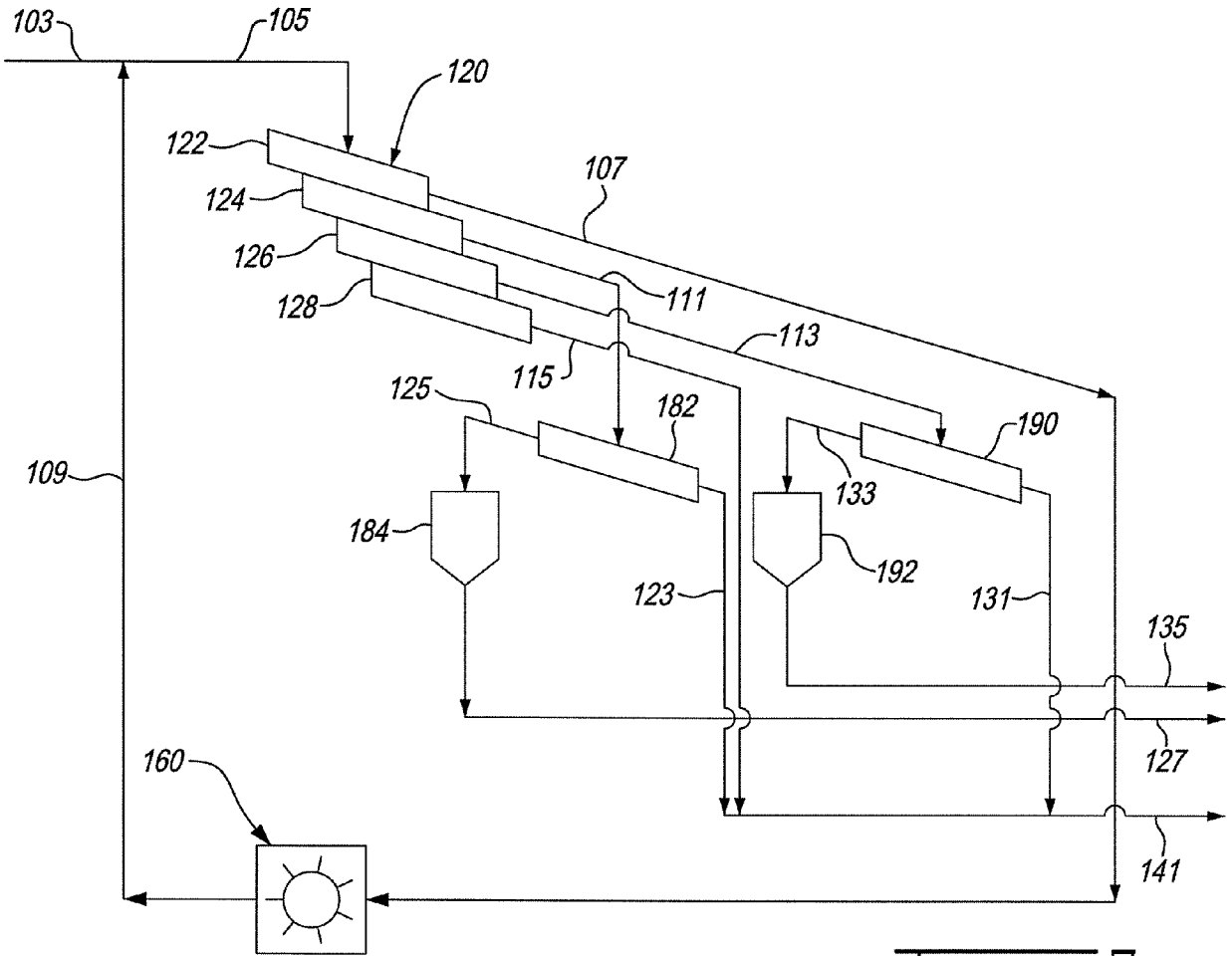
FIG. 2 is a process flow diagram for densifying petroleum coke in accordance with one embodiment of the present invention.

By contrast the process of the present invention one embodiment of which is represented in FIG. 2, uses both size and controlled density separation to produce a petroleum coke product having a higher and more consistent density in a continuous, semi-continuous or batch process mode. Furthermore, the process of the present invention produces a dense coke fraction having a substantially equivalent particle size distribution as that produced by the process of the prior art.

In FIG. 2, an incoming particulate petroleum coke stream 103 is combined with recycle coke stream 109 to produce combined stream 105. The combined coke stream 105 is transported by an appropriate carbon conveyor or system to a particulate size separator. In a preferred embodiment the particulate size separator is a multi-deck vibrating screen 120.

The uppermost screen deck 122 separates out the "oversize" coke fraction 107 which is transported to a crusher 160. The crushed particulate stream 109 leaving the crusher is combined with incoming petroleum coke stream 103.

The "mid-size" fraction streams 111, 113 collected from decks 124, 126 respectively, are each transported to the density separators 182 and 190. Only two fractions are illustrated by the same treatment can be applied to any number of "mid-size" fractions.

The incoming coke streams 111, 113 are each transported or dropped by gravity into a density separator. The density separator in a preferred embodiment is an oscillating table density separator 182, 190. The density separators 182, 190 separate the incoming petroleum coke fraction into at least two particulate fractions in the following ways.

The density separators 182 and 190 have a vibrating and inclined table. The inclined table includes an gas-pervious deck which is designed to retain the incoming petroleum coke fed into the density separator. The inclined table of separators 182, 190 is set at an oscillating frequency which can be regulated and whose action when combined with the upward flow of gas through the gas-pervious deck, stratifies the incoming coke such that particles of greatest density remain adjacent to the inclined table surface and those of lower density distribute further from the table surface. Thus coke fractions of different average density can then be separated from the stratified material.

Separators of this type may be referred to as "destoners" in which the inclination of the table is from a first upper side to an opposite lower side. The opposite lower side includes a dam or wall which is substantially parallel to the first upper side. The dam or wall at the lower side controls the depth of the bed of material to be separated. Other density separators include "gravity separators" in which the inclination of the table is from one upper lower corner (or end) to an opposite lower corner (end). Destoner equipment includes, for example, equipment manufactured by Oliver in Rocky Ford, Colo., USA (model1205) and by Forsberg in Thief River Falls, Minn., USA (model P10). Gravity separators include, for example, Oliver Model 4800 or Forsberg Model 300V.

In a preferred embodiment of the present invention a "destoner" is used. Such equipment is known to be useful for separating particles of substantially different densities, for example, separating seeds (low density) from stone (high density) contaminants, but the "destoner" has not heretofore been applied to separation of a coke stream having a narrow particle size and density, as in the invention. It has been found that the petroleum coke having various fractions, of similar density and similar average particle size can be effectively separated in such equipment, generally considered for only very rough density separation of distinctly different materials.

In the preferred "destoner" embodiment, the density separators 182 and 190 include a gas mover (not illustrated) associated with them, which can take any one of many forms. In a preferred embodiment the gas mover is selected from a blower, a fan, or a reservoir of compressed gas. In a particularly preferred embodiment the gas mover is a centrifugal fan. The centrifugal fan may also include an air dryer and filter at the inlet of the fan. The blower has a pressure and flow rate sufficient to fluidize the mid-size coke stream retained on the gas-pervious deck, and produces a bed of graduated (or graded) density with a denser layer of particles at the bottom of the bed adjacent the deck. The oscillation of the inclined table is such that the dense coke fraction 125 and 133, will climb the inclined surface of the gas-pervious deck so that the denser layer discharges at an upper end of the inclined deck of separators 182 and 190 respectively. In a preferred embodiment the oscillation may be eccentric. A fluidized lighter coke layer tumbles down the inclined deck towards the lower side where a light coke fraction is discharged as streams 123 and 131 from separator 182 and 190 respectively.

Operating parameters of the density separator may be varied manually or automatically via a controller. The operating parameters of the density separator which affect the density of the dense coke fraction include but are not limited to: the feed rate of the incoming coke stream (into the density separator); the oscillation speed (speed, frequency and eccentricity); the vibrational amplitude; the height of the exit dam or wall at the lower side of the deck; the inclination of the gas-previous deck, and the gas flow from the gas mover or blower. These parameters may be adjusted to control the relative flowrates of the dense and the light coke fractions. For a particular embodiment having incoming coke stream flow 111, 113, the average density of the dense fraction 125, 133 is controlled by the relative flowrate of the dense coke fractions. In the present invention, it is preferred that the flowrate of the dense fraction (125, 133) P1, be fixed or established at a preset flow rate. In a preferred embodiment the preset flow rate should be at least 50% of the incoming coke flowrate of the incoming coke stream (111, 113), and more preferably at least 70% of the incoming coke flowrate. The flowrates are generally given in terms of "weight(mass)/time". The separators 182 and 190 are self-regulating with regards to any density fluctuations in the density of the incoming coke streams 111 and 113. That is, the average density of streams 125 and 133 remains relatively constant even as the average density of the incoming streams 111 and 113 varies, requiring no compensating controls to maintain a target average density in streams 125 and 113 in many cases. It will however, be appreciated that if the average density of the incoming streams 111 and 113 falls, for example, the relative flowrate in streams 125 and 133 will fall while the average density remains relatively constant.

It must be emphasized that the stratification in the density separators is such that the average particle size distribution of incoming streams 111 and 113 are substantially equivalent to that of outgoing streams 125 and 133. The expression "substantially equivalent" with respect to the particle size distribution of stream 125 and 133 is defined herein for greater clarity, as a particle size distribution which is similar to that of incoming streams 111 and 113 with respect to ultimate value and ratio of the various size fraction within the distribution with respect to each other, and is such that streams 125 and 133 can be used in the same way (and in the same proportions) as streams 111 and 113 would have been for carbon anode production.

In a preferred embodiment illustrated in FIG. 2, a control system using two storage vessels or product hoppers 184 and 192 which collect the dense coke fractions 125 and 133 respectively are used. The hoppers 184 and 192 act as a buffer for the output of the dense coke fraction streams 125 and 133, by collecting and holding the dense coke fractions and then dosing or feeding the dense coke fraction to the subsequent process at a predefined constant rate (streams 127 and 135) so that a correct proportion of size fractions is maintained. This operation maintains an amount of the dense coke fraction within a predetermined level range in the hoppers 184 and 192, by adjusting the operating parameters of the density separators 182 and 190. It has been found that with either a gravimetric or volumetric feeder at the outlet of hoppers 184 and 192 produces the satisfactory result. Hopper 184 and 192 may be in a preferred embodiment both equipped with level measurement apparatus and integrated controller to avoided running empty and overflowing their contents.

In a preferred embodiment the level control of the system operates in the following manner. The density separators 182 and 190 are set, as explained above, to operate at an established coke flow set point in the dense coke streams 125 and 133 (preferably at least 50% of the total flow 111 and 113 as noted above), which thereby establishes the average coke density in the streams 125 and 133. The operating parameters of the density separators are varied to obtain the preset density value. As has been noted the average density of the dense fraction tends to remain constant once the aforementioned operating parameters above have been appropriately adjusted, even if the densities of the incoming streams 111 and 113 fluctuate.

For clarity, only one flow stream 125 will be discussed, but the same control can be applied to any of the dense streams (125, 133). The flow rate of streams 125 will be identified as P1, and will be preset using the controls on the separator 182 as noted above, and the output flow rate of stream 127 will be identified as P2. The flowrate P2 is controlled by requirements of the downstream anode production process and its flowrate from the hopper 184 is controlled for example by either a weight (mass) or volume feeder. Under some conditions, where the flow rate P1, to hopper 184 is lower than the controlled flow rate P2 out of the hopper, the level of material in hopper 184 would gradually fall and cause the process to stop once the material in the hopper was depleted (or attained a low level shut off switch). The following control method is proposed to avoid the stoppage of the process due to a low level or the reverse situation which would stop the process when the hopper was full.

The simplest embodiment of the present invention comprises a low level measurement and controller on each of the hoppers 184 and 192 which controls the regulator of the density separators 182 and 190 this arrangement maximizes the density enhancement of the dense coke fraction produced while maintaining a constant flow rate of the dense coke fraction out of the hoppers. The separators 182 and 190 may be adapted to receive a signal or signals from one or more controllers, so as to regulate the particulate separation, through the adjustment of the previously discussed operating parameters. Considering again only one separator 182 as a representative example, when the densified coke product in the hopper 184 falls below the low level measurement, the preset flow value, P1 may be varied or adjusted to a higher value which then slightly lowers the average density of the stream 125. This is done by adjusting one or more of the density separator's operating parameters, and maintains the amount of densified coke within a predetermined level. As the influence of the operating parameters on the flow value P1 is generally known, it is not necessary to actually measure the change in P1 to achieve the necessary control. In a preferred embodiment, the gas flow is adjusted, in such a way as to deliver a larger amount of material to the densified coke streams 125 from the density separators 182. The amount of densified coke in hopper 184 is slowly refilled to a higher level, albeit at a slightly lower density level, but still higher than if the separation is conducted without a density separator 182. As noted the same control method may be applied to any of the density separator herein discussed. The hoppers 184 and 192, may in some embodiments each be replaced by multiple hoppers in parallel in which case the average of levels in the multiple hoppers is compared to the low level limit.

More complex control methods can be envisaged which include two or more stages of low level detection with two or more predefined adjustment strategies for P1. In a preferred embodiment the control method would include two level measurements and adjustment strategies.

Clearly, the hoppers 184 and 192 may also have a complimentary system to that of a low level, with a one or more high level measurement and control system, which would work in an analogous yet opposite manner as the low level measurement. The high level measurement would increase the preset flow value and thus reduce the flow of densified coke product leaving the separators 182 and 190.

Therefore the separators 182, 190 produce the dense coke fraction in streams 127, 135, and light coke fraction in streams 123, 131 respectively.

Considering FIG. 2 once again, the light or lower density coke fraction streams 123, 131 are combined with the "undersize" coke stream 115 from the bottom 128 of the multi-deck screen 120. This combined undersized fraction stream 141 is further milled to reduce its average particle size. Similarly as in FIG. 1, this milled "undersize" stream 141 of FIG. 2, may be combined with the densified particulate coke product streams 127 and 135 (not shown) in the appropriate proportions to produce carbon anodes for aluminum production.

Figure 3:
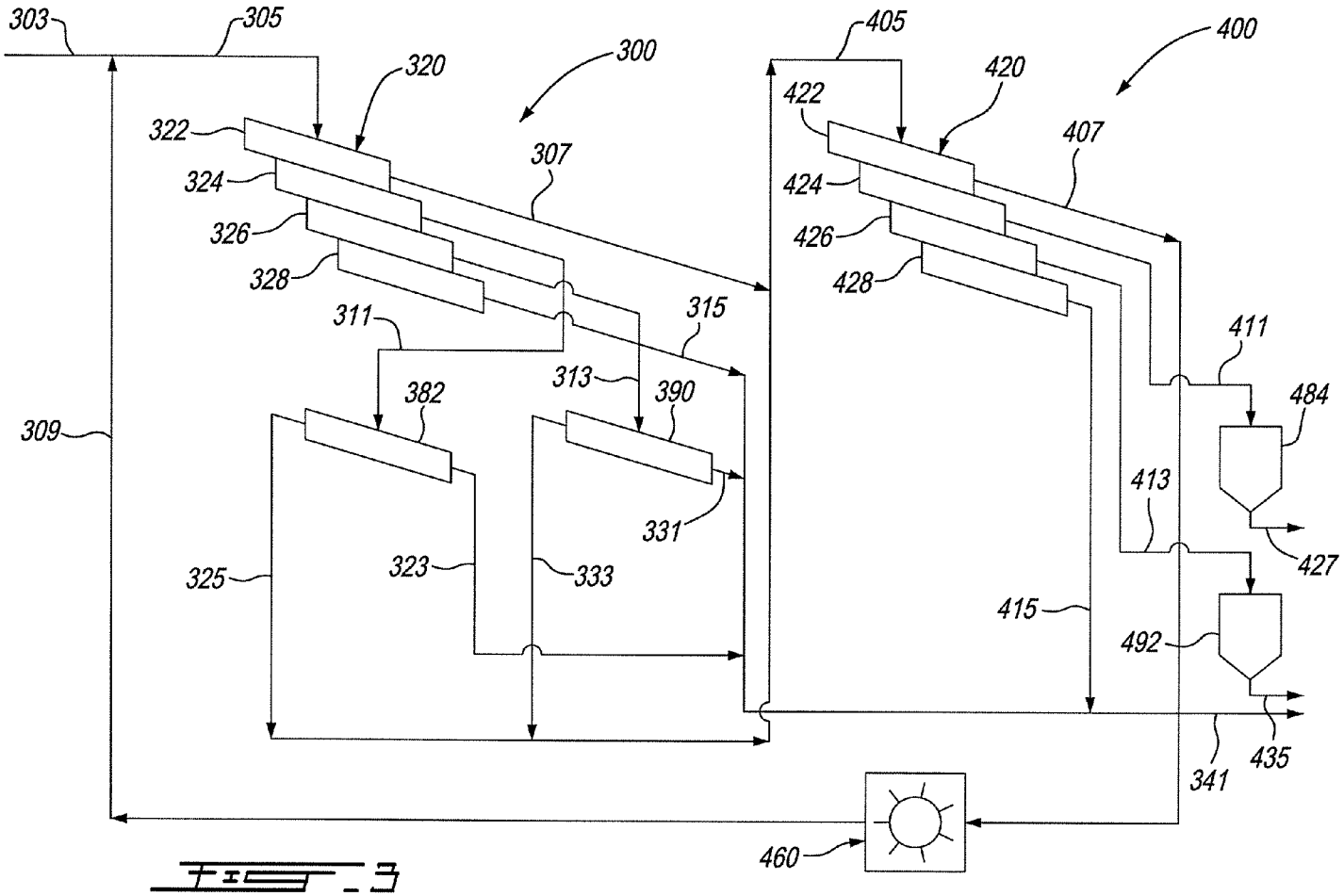
FIG. 3 is a process flow diagram for the densification of petroleum coke in accordance with a second embodiment of the present invention.

FIG. 3 represents another embodiment of the process and apparatus of the present invention. The equipment and stream numbers which begin with 300 are analogous to the process described in FIG. 2. The system 300 (beginning with reference numerals in the 300s) could be envisaged as a retrofit added to an existing petroleum coke classification system 400 (the existing system is identified with reference numbers beginning with 400). The total system (combined systems 300 and 400) of FIG. 3 could be envisaged where modifications to the existing system 300 are difficult or impossible due to a variety of physical constraints, such as lack of space for new densification equipment in an existing building.

The system receives an incoming petroleum coke stream 303, which is combined with a recycle stream 309 to produce a combined stream 305, which is then fed to a multi-deck screen 320. The screen 320 in a preferred embodiment includes three decks 322, 324, 326 and bottom 328 from which the following sized coke streams are taken respectively: "oversize" stream, 307; a first "mid-size" stream, 311; a second "mid-sized, 313; and an "undersized" stream 315.

The particles of the "mid-size" streams 311 and 313 are then separated in density separators 382 and 390, which split the incoming streams 311, 313 into lower density fractions 323 and 331 and high density fractions 325 and 333 respectively.

The under-size fraction 315, and the two lower density fractions 323 and 331 are combined into stream 341 and transported for further milling (not shown).

The high density fractions 325, 333 are combined with "oversize" stream 307 into stream 405, which is conveyed to the existing system 400 of petroleum coke classification. The existing system is similar to that described in FIG. 1 with the important difference that because the "mid-size" streams have been densified they will leave the existing classification system at a higher density.

Stream 405 is placed on a multi-deck screen 420, comprising three decks 422, 424, 426 and bottom 428, where the following sized coke streams are collected respectively: "oversize" stream, 407; a first "mid-size" stream, 411; a second "mid-sized, 413; and an "undersized" stream 415. The "oversize" stream 407 is transported to a crusher 460 where its size is reduced. The crushed stream 309 is combined with incoming stream 303. "Mid-size" streams 411 and 413 are then fed to hoppers 484 and 492. These hoppers are equipped with the same level control systems as described in FIG. 2 (on hoppers 184 and 192), but provide feedback to the separator (382 and 390) that is used to process substantially the same size fraction as in the stream feeding the hopper. The output of the hoppers 484 and 492 specifically streams 427 and 435 respectively are then used, with the fines in the production of carbon anodes for aluminum production. Where a different number of separations are used in the screen 420 and 320 with the number of separations from screen 320 greater than or equal to the number from 420, then the levels in the hoppers associated with a particular size fraction from screen 420 are associated with the closest size fraction stream or streams from screen 320. Where the number of separation streams from screen 320 is less than that of screen 420, the levels in more than one hopper may be averaged then applied to the closest sized stream fraction from screen 320.

TABLE 1

Results of Example 1

| | | | Density Separator of the Present Invention | | | | Air Knife Separation | | | |
|---|---|---|---|---|---|---|---|---|---|---|
| Sample | Incoming mesh size | Incoming Coarse fraction mesh size % | Air flow (CFM) | % low density output stream | Gain in average density of higher density stream (g/cm$^3$) | Coarse Fraction in lower density output stream | Air flow (CFM) | % low density output stream | Gain in average density of higher density stream (g/cm$^3$) | Coarse Fraction in lower density output stream |
| Coke A | −4 to +14 | 18% + 6 | 3070 | 14% | 0.12 | 15% + 6 | 2823 | 14% | 0.03 | 1% + 6 |
| Coke B | −2.5 to +9 | 22% + 4 | 4595 | 8% | 0.03 | 16% + 4 | 2328 | 4% | 0.00 | 0% + 4 |
| Coke C | −9 to +48 | 7% + 14 | 1741 | 15% | 0.04 | 4% + 14 | 1697 | 15% | 0.00 | 0% + 14 |

Example 1

This example will illustrate the benefit of the use of the process and apparatus of the present invention in increasing the density of the petroleum coke processed and that without substantially altering the average particle size distribution of the densified coke product produced as compared to the initial average particle size distribution of a first or feed coke fraction received into the density separators of the present invention. Thus the density separator will produce a dense coke fraction which has a higher density than the coke of the prior art but will have a substantially equivalent particle size distribution as the coke fraction entering the density separator.

Three samples of coke of different initial average particle size distribution were processed in the apparatus of the density separator of the present invention and by using an air knife as suggested in the prior art.

The initial or first average particle size distribution (mesh size) and the percent "coarse" fraction were determined for each sample and the percent "low density" separated, the gain in average density between the light layer (the lower density fraction) and the dense layer (the higher density fraction) were determined.

The results of Example 1 are presented in Table 1 and show that although the lower and higher density fractions split was about the same in both methods (the % low density), the separator of the present invention gave a greater gain in density in the higher density stream. Importantly, the amount of coarse material in the exit streams from the separator of the present invention was almost unchanged from the incoming stream, which indicates that there was a density enhancement without a change in size distribution, that is input and output streams were substantially equivalent. By comparison the density separation with the air knife, showed that the coarse fraction was almost missing from the low density stream, thus indicating that the air knife performed a size classification at the same time as the density separation was occurring. This finding with respect to the air knife is consistent with an air knife separation being based on weight rather than density.

Example 2

In Example 2 the benefits of the densification of petroleum coke by the process and the apparatus of the present invention will be illustrated, particularly the positive effects of the increased coke density on baked carbon anode (electrode) properties.

Figure 4:
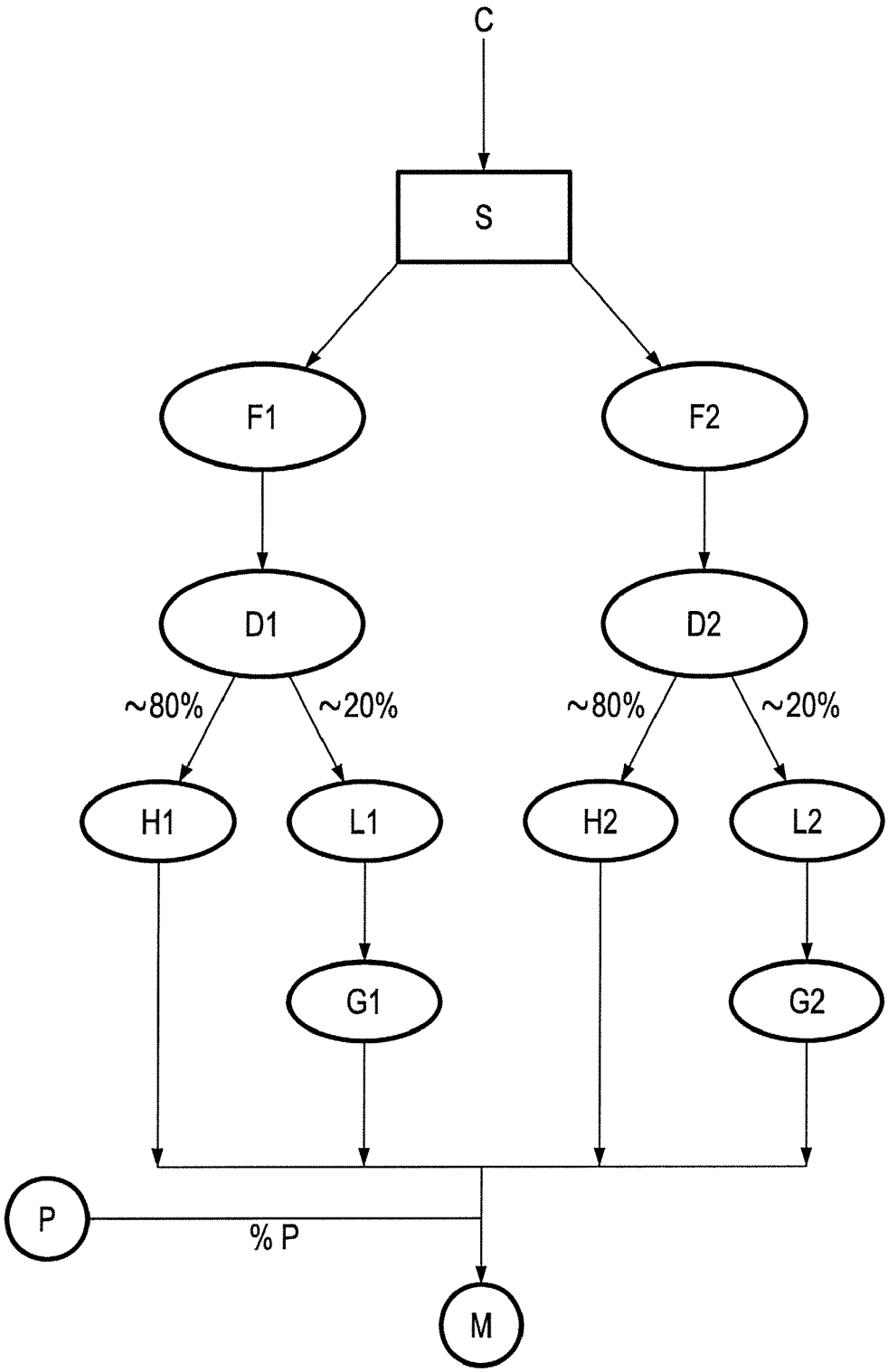
FIG. 4 is a process flow diagram of the experimental procedure used to manufacture test electrodes.

The production of electrodes using the process of the present invention according to Example 2 is schematically represented in FIG. 4.

The incoming petroleum coke (C) is screened at (S) into two size fraction F1 and F2. The coarse fraction F1 having an average particle size distribution of 0.371 inches to +4 mesh is produced. The intermediate size fraction F2 having an average particle size distribution of −4 to +14 mesh is also produced. F1 and F2 with each respectively treated in the density separators of the present invention D1 and D2. Both D1 and D2 produced a denser and a lighter fraction H1/L1 and H2/L2 where the ratio of H1/L1 and H2/L2 was approximately 80%/20% by weight. This separation weight ratio may vary from 76%/24% to 84%/16%. The density separators were a Forsberg Inc. Destoner Model G2 type, adjusted to give these high density/low density splits. This required, for example, D1 to be operated with a dam height of 9 mm, an elevation of 8.7 degrees and a pitch (degree of oscillation) of 1.0 mm at the lower (light) end and 1.5 mm at the upper (heavy) end. Airflows of about 470 cfm are required. The lower density fractions L1 and L2 are ground or crushed in G1 and G2 to finer fractions and combined. This combined ground fraction is further combined with H1 and H2 with varying amounts of pitch (P) binder and manufactured (M) into carbon anodes (electrodes) suitable for aluminum production.

Two samples of (C) were independently tested in the process represented in FIG. 4: Coke A having an average initial density $\rho_A$ of 0.882 g/cm$^3$ and Coke B with an average initial density $\rho_B$ of 0.777 g/cm$^3$.

Figure 5A:
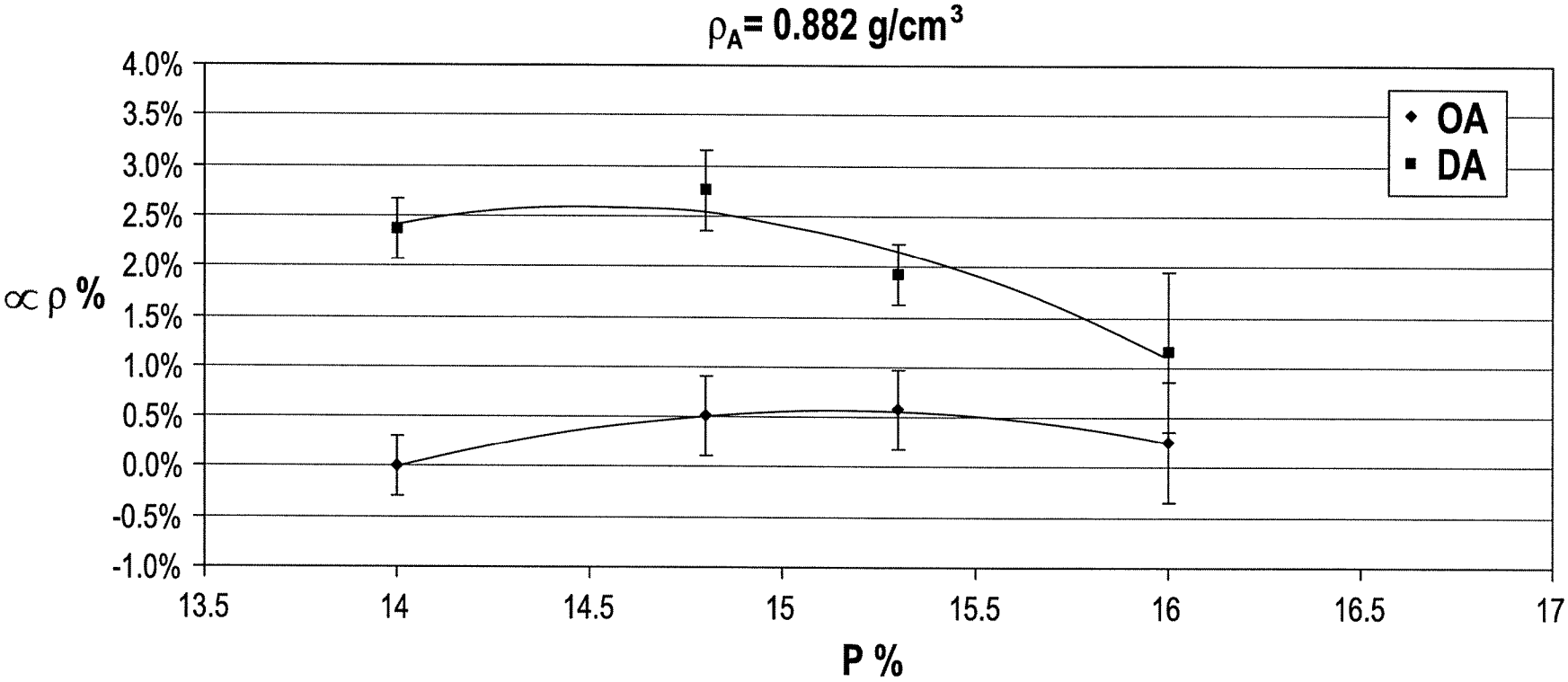
FIG. 5*a* is a plot of the baked anode density versus pitch % for an anode produced from a sample (Coke A) and from a sample of densified Coke A produced according to one embodiment of the present invention.
Figure 5B:
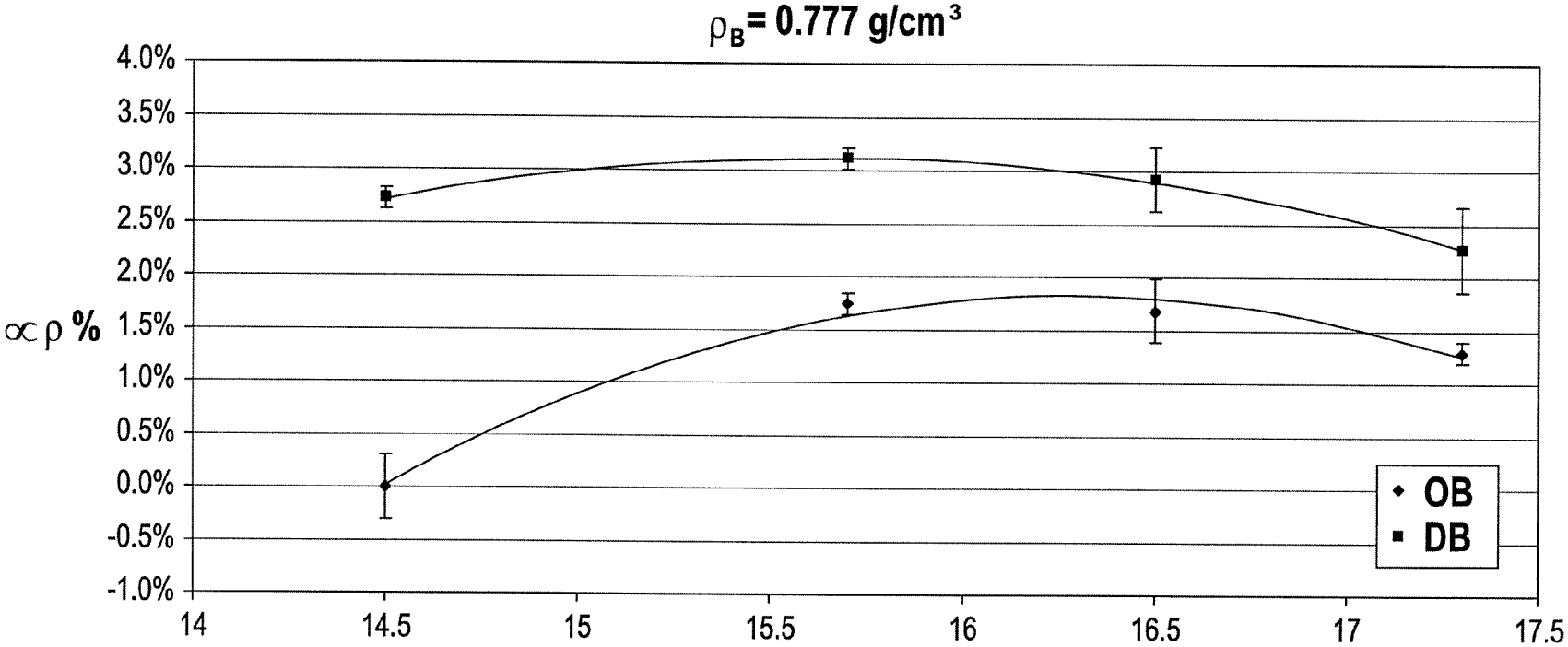
FIG. 5*b* is a plot as per FIG. 5*a* using a sample of low density coke (Coke B) and from a sample of densified coke B produced according to on embodiment of the present invention.

FIGS. 5*a* and 5*b* represent the plots of the baked density versus percentage pitch (P %) binder by relative increase in baked density respectively ($\propto\rho$%) for sample Coke A and sample Coke B. Furthermore, in FIGS. 5*a* and 5*b* the curves represented by DA and DB respectively represent anodes produced from a densified sample produced by the process of the present invention, while OA and OB respectively represents anodes produced from the original coke without processing by the present invention. Both DA and DB show a higher relative baked anode density and the maximum baked density occurring at lower binder pitch (P %) for the densified petroleum coke, when compared to the unprocessed petroleum coke OA and OB.

Example 3

Example 3 illustrates the ability of the density separator of the present invention to compensate and self regulate for variations in density in the feed coke stream without the need for control loop (such as a feedback control loop).

The density separator of the present invention treated continuously two petroleum coke samples having different average density (Coke 1 where the density $\rho=0.80$ g/cm$^3$ and Coke 2 where $\rho=0.76$ g/cm$^3$). The two petroleum cokes were fed alternately to the density separator of the present invention without adjusting any parameter of separation during operation. The period of treatment for each coke was 10 minutes. The input coke and the densified coke product fraction were sampled every minute and their density measured. The total percentage of separation (% low density fraction) was 19.6%.

Figure 6:
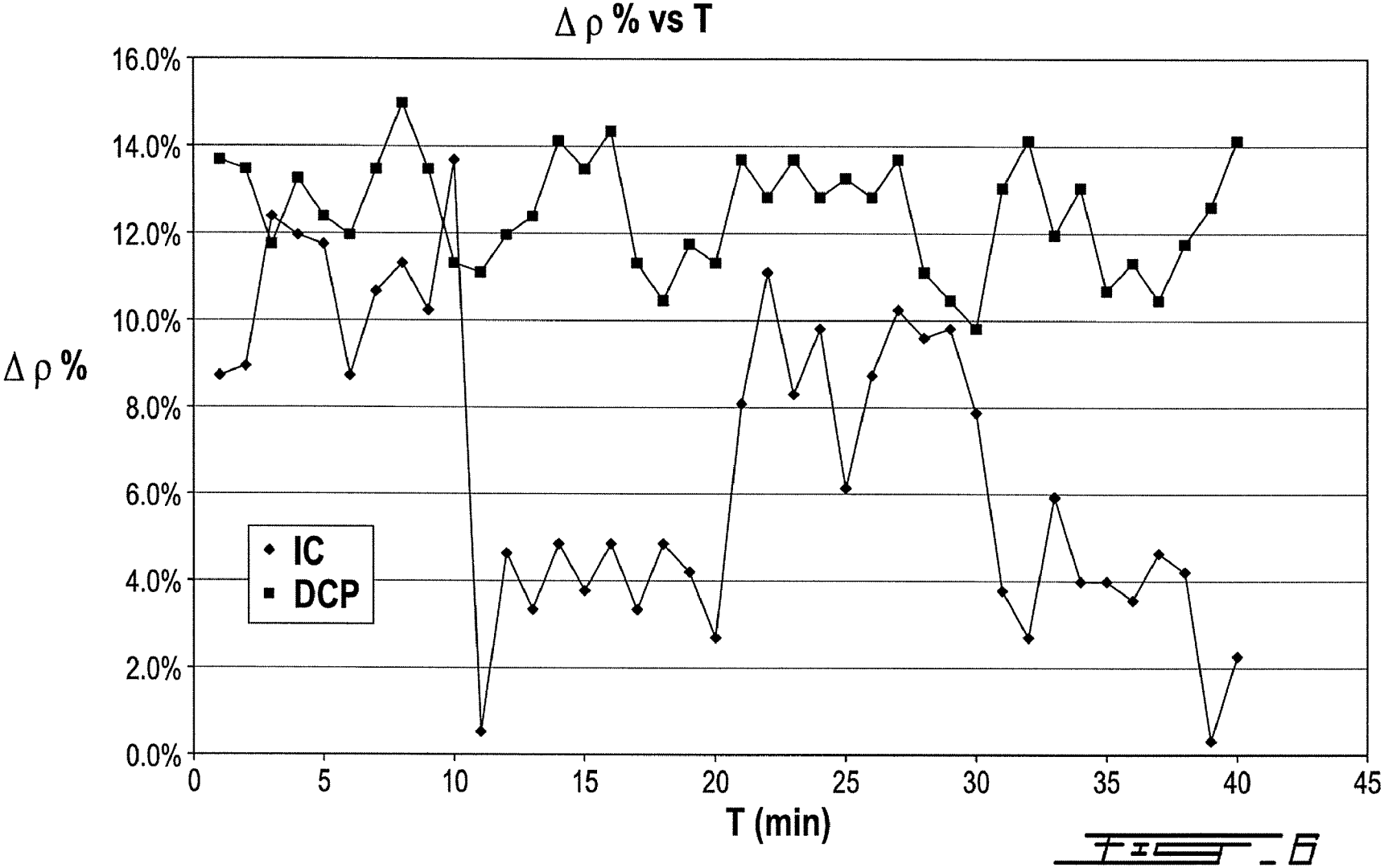
FIG. 6 is a graph of the density of incoming petroleum coke and densified petroleum coke produced according to the present invention versus the time (in minutes) of coke sample treatment within the apparatus of the present invention.

The results presented in Table 2 and in FIG. 6 illustrate that the petroleum coke separation using the density separator of the present invention is automatically self adjusting or regulating. FIG. 6 represent the plots of the change density of the incoming coke (IC) and densified coke product (DCP) versus a sample treatment at a given time T, (minutes). We see from the Table 2 and from FIG. 6 that despite the larger and continuous variation in the incoming coke stream (IC), the densified coke product (DCP) produced by the process and the apparatus of the present invention is densified to an average and constant value of 0.82 g/cm$^3$. This is an increase of at least 0.04 g/cm$^3$. The consistency of the densification of the product is also clearly illustrated by the lower standard deviation of the densified product presented in Table 2, which varies substantially less than the incoming petroleum coke stream.

TABLE 2

Summary of results from Example 3

| Density of the input Petroleum Coke | | Density of the Petroleum Coke after density separation according to the present invention (densified coke product) | |
|---|---|---|---|
| Average | Std. Deviation | Average | Std. Deviation |
| 0.78 | 0.03 | 0.82 | 0.01 |

The embodiment(s) of the invention described above is(are) intended to be exemplary only. The scope of the invention is therefore intended to be limited solely by the scope of the appended claims.

The invention claimed is:

1. A process for separating a dense coke fraction from a first particulate coke stream for carbon anode production by providing a first particulate coke stream having a first average density and a first average particle size distribution, the process comprising steps of:

feeding the first particulate coke stream to a density separator at an incoming flow rate;

stratifying the first particulate coke stream in a density separator into a bed of graded density comprising at least two separate particulate fractions of different average density using an upward flow of gas, the at least two fractions comprising a light coke fraction and the dense coke fraction, wherein the dense coke fraction is found in a layer at the bottom of the graded bed; and separating the light coke fraction in the density separator, the dense coke fraction having an average density which is greater than the first average density and an average particle size distribution substantially equivalent to the first average particle size distribution, wherein the dense coke fraction is discharged from an upper end of an inclined oscillating table of the density separator.

2. The process of claim 1, further comprising establishing a preset flow rate for the dense coke fraction corresponding to a desired density for the dense coke fraction, and adjusting the density separator such that the dense coke fraction attains the preset flow rate.

3. The process of claim 2, wherein the preset flow rate is at least 50% of the incoming flow rate.

4. The process of claim 3, wherein the preset flow rate is at least 70% of the incoming flow rate.

5. The process of claim 4, further comprising feeding the dense coke fraction from the density separator at the preset flow rate into a storage vessel;

dosing the dense coke fraction from the storage vessel at a constant flow rate;

maintaining an amount of the dense coke fraction in the storage vessel within a predetermined level range by adjusting the density separator.

6. The process of claim 5, wherein adjusting the density separator is through adjustment of at least one operating parameter selected from the group consisting of: oscillation speed, oscillation frequency, oscillation eccentricity, vibrational amplitude, height of the exit dam, deck inclination and a gas flow through pervious deck.

7. The process of claim 6, wherein a percentage change between the preset flow rate and the constant flow rate is obtained by a level measurement control in the storage vessel.

8. The process of claim 7, wherein the level measurement control acts on the at least one operating parameter to control the preset flow rate.

9. The process of claim 8, wherein dosing the dense coke fraction from the storage vessel is volumetric.

10. The process of claim 8, wherein dosing the dense coke fraction from the storage vessel is gravimetric.

11. A process for separating a dense coke fraction from an incoming particulate coke fraction for carbon anode production, the process comprising steps of:

providing the incoming particulate coke stream, combining the incoming particulate coke stream with a recycle stream to produce a combined feed coke stream, feeding the combined feed coke stream to a particle size separator, separating the combined feed coke stream into one oversize coke fraction, at least one mid-size coke fraction, and an undersize size fraction, wherein the mid-size coke fraction has a first average density and a first average particle size distribution;

feeding the mid-size coke stream to a density separator at an incoming flow rate; and stratifying the mid-size coke stream in the density separator into a bed of graded density comprising at least two separate particulate fractions of different average density using an upward flow of gas, the at least two fractions comprising a light coke fraction and the dense coke fraction, wherein the dense coke fraction is found in a layer at the bottom of the graded bed; and separating the light coke fraction from the dense coke fraction in the density separator, the dense coke fraction has an average density which is greater than the first average density and an average particle size distribution substantially equivalent to the first average particle size distribution, wherein the dense coke fraction is discharged from an upper end of an inclined oscillating table of the density separator.

12. The process of claim 11, wherein grinding the oversize coke fraction produces the recycle stream.

13. The process of claim 12, further comprising establishing a preset flow rate for the dense coke fraction corresponding to a desired density for the dense coke fraction, and adjusting the density separator such that the dense coke fraction attains the preset flow rate.

14. The process of claim 13, wherein the preset flow rate is at least 50% of the first rate.

15. The process of claim 14, wherein the preset flow rate is at least 70% of the first rate.

16. The process of claim 15, further comprising feeding the dense coke fraction from the density separator at the preset rate into a storage vessel;

dosing the dense coke fraction from the storage vessel at a constant flow rate; maintaining an amount of the dense coke fraction in the storage vessel within a predetermined level range by adjusting the density separator.

17. The process of claim 16, wherein adjusting the density separator is through adjustment of at least one operating parameter selected from the group consisting of: oscillation speed, oscillation frequency, oscillation eccentricity, vibrational amplitude, height of the exit dam, deck inclination and a gas flow through pervious deck.

18. The process of claim 17, wherein a percentage change between the preset flow rate and the constant flow rate is obtained by a level measurement control in the storage vessel.

19. The process of claim 18, wherein the level measurement control acts on the least one operating parameter to control the preset flow rate.

20. The process of claim 19, wherein dosing the dense coke fraction from the storage vessel is volumetric.

21. The process of claim 19, wherein dosing the dense coke fraction from the storage vessel is gravimetric.

* * * * *